US006062916A

United States Patent [19]

Gladd et al.

[11] Patent Number: 6,062,916

[45] Date of Patent: May 16, 2000

[54] PRINTED CIRCUIT BOARD WITH PASS THROUGH BUSSED TERMINAL SYSTEM FOR A BUSSED ELECTRICAL DISTRIBUTION CENTER

[75] Inventors: Joseph H. Gladd, Cortland; Jeffrey M. Hickox, Middlefield; Raymond J. Blasko, Boardman; George W. Powell, Cortland, all of Ohio

[73] Assignee: General Motors Corporation, Detroit, Mich.

[21] Appl. No.: 09/115,466

[22] Filed: Jul. 14, 1998

[51] Int. Cl.[7] ..... H01R 13/42

[52] U.S. Cl. ..... 439/751; 439/82; 439/876

[58] Field of Search ..... 439/82, 83, 751, 439/947.2

[56] References Cited

U.S. PATENT DOCUMENTS

| | | | |
|---|---|---|---|
| 4,908,942 | 3/1990 | Long et al. | 439/82 |
| 4,909,754 | 3/1990 | Paradis | 439/751 |
| 5,004,426 | 4/1991 | Barnett | 439/82 |

*Primary Examiner*—Khiem Nguyen
*Assistant Examiner*—J. F. Duverne
*Attorney, Agent, or Firm*—Patrick M. Griffin

[57] ABSTRACT

An electrical distribution center including a printed circuit board having electronic components thereon and a first and second through hole formed in the print circuit board. A terminal is provided which may be a female tuning fork, male blade or blank for insertion in the first through hole. A solderable spring tab is stamped, bent and formed from the body the terminal. The solderable spring tab is inserted in the second through hole. The solderable spring tab compensates for movement of components due to the difference in thermal expansion of the printed circuit board, solder joint, and terminal material.

17 Claims, 3 Drawing Sheets

PRINTED CIRCUIT BOARD WITH PASS THROUGH BUSSED TERMINAL SYSTEM FOR A BUSSED ELECTRICAL DISTRIBUTION CENTER

TECHNICAL FIELD

This invention relates to a printed circuit board/terminal combination, and more particularly to a bussed electrical center having a printed circuit board with electrical terminals.

BACKGROUND OF THE INVENTION

Electrical distribution centers or bussed electrical centers are currently being widely used in automobiles. The bussed electrical center is simply a central junction block system designed as a stand-alone assembly. This junction block can package an array of fuses, relays and electrical devices in a central location. The bussed electrical center not only reduces cost by consolidating these various functions into one block, but the center also reduces the number of cuts and splice leads which increases reliability. However, due to the increased demand for electrical functionality in automobiles it is desirable to include printed circuit board electronics in the bussed electrical centers. These printed circuit boards will require electrical connections to devices such as fuses, relays and wire harness connectors.

Utilizing traditional connector methods would require a terminal formed on a first side of the circuit board in the up direction and a terminal formed on a second side of the circuit board in the down direction. Multiple terminals add mass, and a substantial amount of valuable real estate is utilized on the circuit board. Making a direct solder connection from the terminal to the circuit board also has problems associated with the differences in the thermal coefficient of expansion between the terminal, solder, and circuit board. To date, no suitable connection has been developed to accommodate problems associated with utilizing a printed circuit board/terminal connection in an electrical distribution center.

The present invention provides alternatives to and advantages over the prior art.

SUMMARY OF THE INVENTION

The present invention incorporates a terminal design that can be soldered into a printed circuit board to provide a compliant redundant electrical interface to the printed circuit board, and an electrical connection to an electronic/electrical device or wire harness circuit. The design requires a minimal footprinted on the printed circuit board, is simple to manufacture and assembled, provides optional high current busing as well as reliable low energy interface, and satisfies low mass and costs requirements.

In one embodiment of the present invention, the terminal may be a female tuning fork, male blade or blank. A solderable spring tab is stamped, bent and formed from the body of the terminal. The solderable spring tab compensates for movement of components due to the difference in thermal expansion of the printed circuit board, solder joint, and terminal material.

An additional feature of the present invention is a compliant contact that remains in the body of the terminal after the solder tab has been formed. The resultant terminal has a main body portion having two sides strips of metal separated by the hole left by punching out the the solderable spring tab. The compliant feature operates such that when the terminal is inserted into a slot in the printed circuit board, the terminal free falls until the tapered edges of the terminal comes in contact with the edges forming the printed circuit board slot. As a terminal is inserted deeper, the metal of the side strips deforms into the hole formed in the terminal and the outer edges of the terminal stock embed themselves into the corner of the punch slot in the printed circuit board.

These and other objects, features and advantages of the present invention will become apparent from the following brief description of the drawings, detailed description, and appended claims and drawings.

DESCRIPTION OF THE PREFERRED EMBODIMENT

Figure 1:
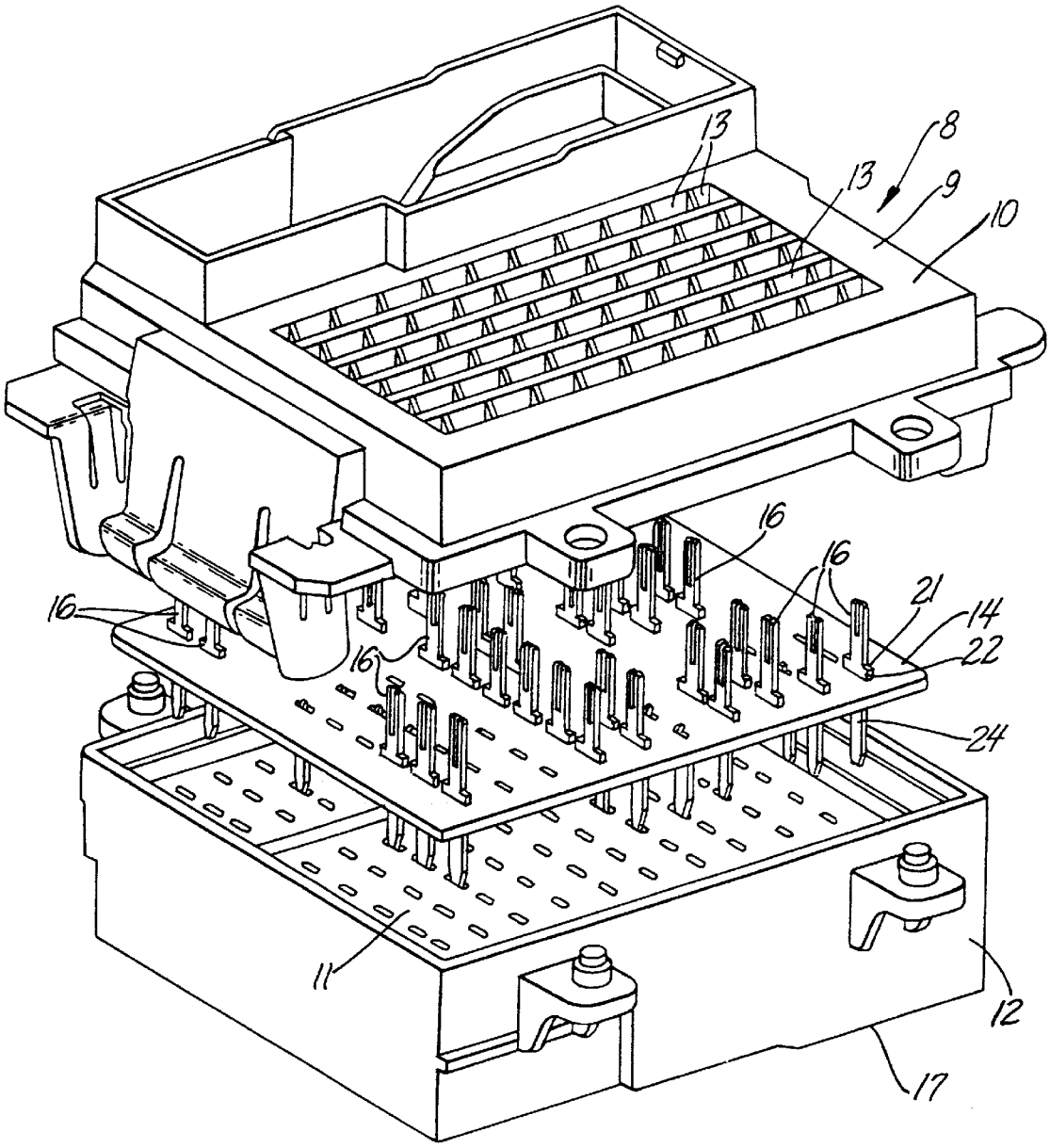
FIG. 1 is an exploded view of a printed circuit board/bussed electrical distribution center assembly having pass-through terminals according to the present invention.

Referring now to FIG. 1, the present invention includes a printed circuit board for use in an electrical distribution center 8 having an upper housing 10 mateable with a lower housing 12 and a printed circuit board 14 sandwiched therebetween. A plurality of pass-through terminals 16 extend through the print circuit board 14. Naturally the printed circuit board 14 may include a plurality of electrical electronic components, devices and circuits in a manner which is known to those skilled in the art. The terminals 16 are inserted in slots or holes formed in the printed circuit board 14 utilizing a unique method of the present invention. The upper and lower housings 10, 12 each have a base 9,11 with slots or holes 13, 15 respectively formed therethrough for receiving and electrical engagement features such as a male blade or tuning fork of the terminal, or for receiving an electrical engagement feature of a device such as a fuse or relay. The upper housing 10 includes engagement surfaces (not shown) stopping on the upper edge 21 of each side tab 20 of the terminal. The underside 17 of the lower housing 12 includes a plurality of bays for receiving a wire harness connectors including terminals for mating with the lower electrical engagement feature 24 of the terminal. A plurality of electrical electronic devices such that is mini-fuses, maxi-fuses, relays and the like (not shown) may be mated to the terminal 16 in a manner which is known to those skilled in the art of assembling electrical distribution centers for automobiles and other vehicles.

Figure 2:
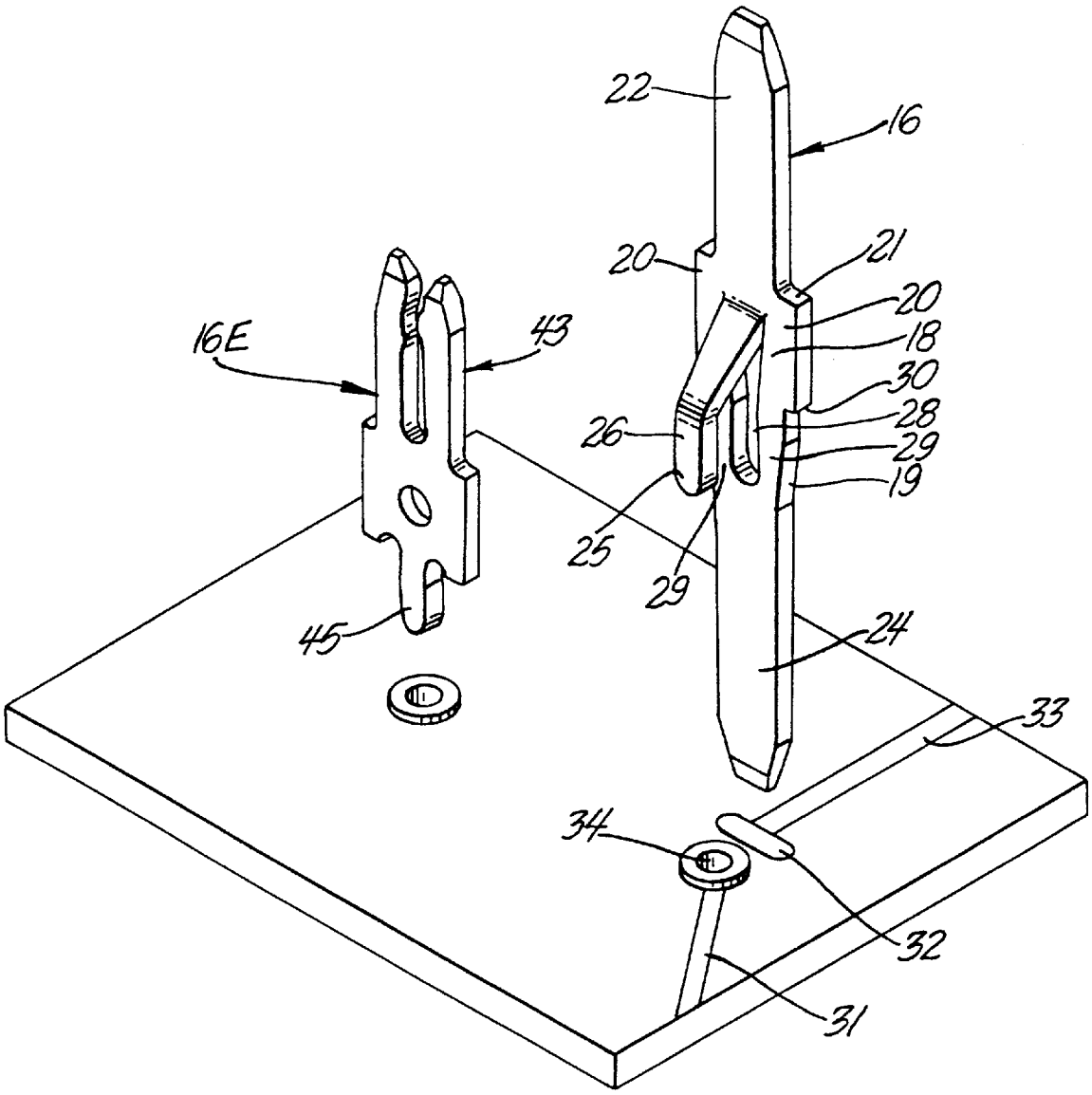
FIG. 2 is an exploded view of a printed circuit board and terminal combination useful in the present invention.

FIG. 2 illustrates a terminal and print circuit board combination according to the present invention. In the case of one embodiment of the terminal 16, the terminal is formed from a flat blank to include a main body portion 18 including tapered side edges 19 at a lower end thereof, a pair of tabs 20 each extending outwardly from opposite sides of the main body portion 18. An upper (first) electrical connection feature 22 (which in this case is a male blade) extends in an upward direction from the main body portion 18 and a lower (second) electrical engagement portion 24 (in this case is also a male blade) extends downwardly from the main body portion 18. A solderable spring tab 26 is cut and bent out of the main body portion 18 to leave the a hole 28 in the main body portion. Two side strips 29 of metal in the main body portion are separated by the hole 28. A solder cladding is formed on a lower edge 30 of each of the tabs 20.

A slotted through hole 32 is formed in printed circuit board. A plated through hole 34 is also formed adjacent adjacent to the slotted hole 32. The lower electrical engagement feature 24 (in this case the male blade) or mounting tail of the terminal is inserted into the slotted through hole 32 and free falls until the tapered side edges 19 engage the walls of the print circuit board forming the slotted through hole 32. As a terminal is inserted deeper into the slot, the metal of the side strips 29 deform into the hole 28 (left by forming the solderable spring 26) and the outer edges of the side strips 29 embed themselves in the corners of the slotted through hole 32 in the printed circuit board. Because the terminal material wishes to return back to its original position, the terminal applies provides a contact normal force that is required to sustain a stable terminal interface. The free end 25 of solderable spring tab 26 is inserted into the plated through hole 34. The solderable spring tab 26 is used to connect each terminal during the die process and doubles as a high current caring path for circuit busing. The solderable spring tab 26 also provides a compliant spring force the overcomes movement due to differences in the thermal coefficient of expansion between the terminal 16, printed circuit board 14 and the solder material on the side tabs 20 and the plated through hole 34. The printed circuit board 14 and terminal 16 are heated so that the solder cladding on the lower edge of the side tabs 20 and the material on the plated through hole 34 reflow and are cooled to secure the terminal to the printed circuit board. Soldering the spring tab 26 or the lower end of the side tabs 20 extending from the main body portion allows the terminal to include a second electrical engagement features such as a male blade or tuning fork extending through and out of the other side of the printed circuit board. Prior art methods of attaching terminals to printed circuit boards involved the use of a solder bath which would result in the second (lower) electrical engagement feature 24 being completely covered with solder if it were inserted through a slot in a printed circuit board. This is undesirable because the plating is not smooth and would require higher engagement forces for making an electrical connection, and the plating may result in a contaminated surface.

Referring again to FIG. 2, the round hole 34 in the print circuit board is copper plated and an electrical circuit trace 31 is connected to the plating. The slot 32 in the print circuit board may be a dummy slot that does not make electrical connection to the terminal or the slot area may also be copper plated and have an associated electrical circuit trace 33 attached thereto.

Figure 3:
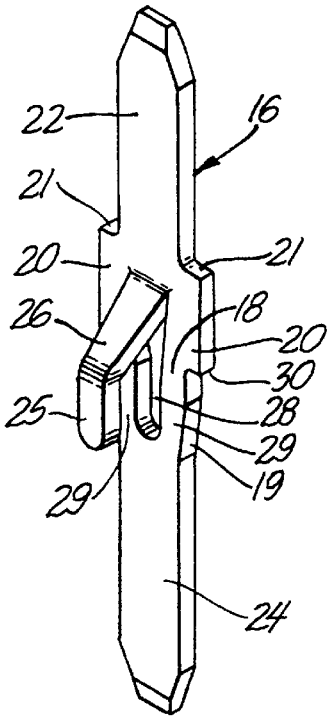
FIG. 3 is an enlarged view of the terminal according to the present invention.

A variety of different terminal styles and designs are useful in the present invention. Referring now to FIG. 3, this enlarged view of a terminal 16 according to the present invention includes tapered sides 19 on the main body portion 18 and a tapered hole 28 left by stamping, forming and bending the solderable spring tab 26 out of the main body portion. Again, in this embodiment of the terminal, both the first and second electrical engagement features 22, 24 are male blades.

Figure 4:
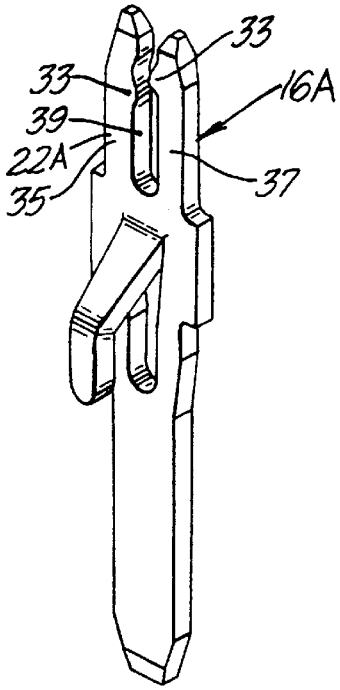
FIG. 4 is an enlarged view of another embodiment of a terminal according to the present invention.

Referring now to FIG. 4, an alternative terminal 16A includes a tuning fork terminal portion for the first electrical engagement feature 22A. As known to those skilled in the art, the tuning fork includes two spaced apart fingers 35, 37 which define a slot 39 therebetween for receiving an electrical engagement feature (such as a male blade) of another device. The inside edge of each of be fingers 35, 37 may include raised nubs 33 to provide a better frictional fit of a male blade or another tuning fork received between the fingers.

Figure 5:
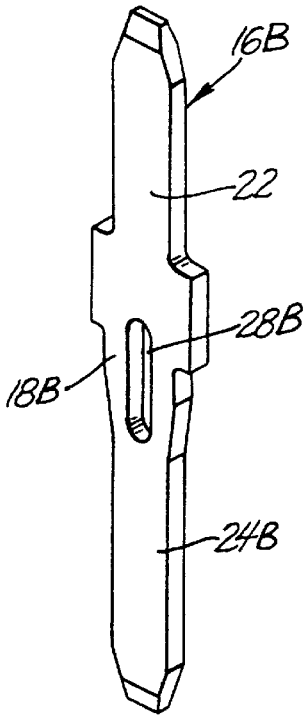
FIG. 5 is an enlarged view of another embodiment of the terminal according to the present invention.

Referring now to FIG. 5, another alternative terminal 16B according to the present invention does not utilize the solderable spring tab but includes a hole 28B formed through the main body portion 18B. In this particular case the hole 28B has a slot like configuration and both the first and second electrical engagement features 22B, 24B are male blades.

Figure 6:
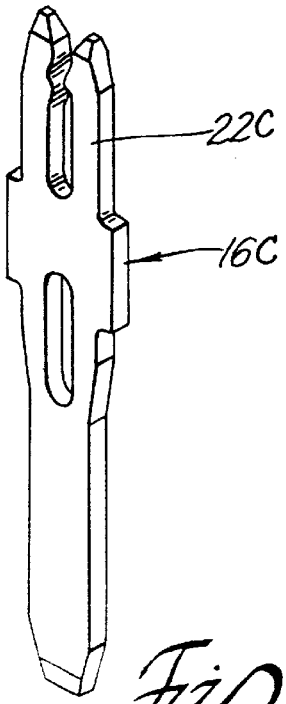
FIG. 6 is an enlarged view of another embodiment of a terminal according to present invention.

Referring now to FIG. 6, another alternative terminal 16C of the present invention is similar to that shown in FIG. 5, however, the first electrical engagement feature 22 is a tuning fork as described earlier.

Figure 7:
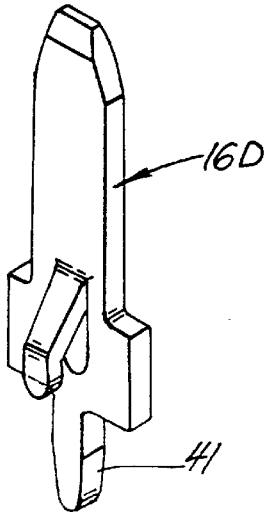
FIG. 7 is an enlarged view of another embodiment of the terminal according to the present invention.

Referring now to FIG. 7, the lower electrical engagement feature of still another alternative terminal 16D a short mounting tail 41 (in this case that used for making electrical connection) and print circuit board may include a round hole to accommodate the mounting tail 41 instead of a slot as shown in FIG. 2 in association with yet another alternative terminal 22E that has a tuning fork feature 43 in combination with a short mounting tail 45.

The present invention includes a method of attaching the terminal to a printed circuit board to provide a low-cost reliable interface. The terminal has a simple design, but may include a variety of electrical engagement feature designs. The terminals can be produced in a variety of styles and at high-speed, thus reducing cost, and may be provided on a reel as a convenient method to introduce the terminals in a process of inserting the terminals into the printed circuit board. High current busing can be accomplished with through the printed circuit board style terminals or using the terminal carrier tabs 20 as a circuit bus. In such a case, two terminals or more are connected together by the side tabs 20 extending therebetween. Such a terminal is shown in Brasslis et al, U.S. Pat. No. 5,715,135 entitled "Electrical Distribution Center with Two-piece Insulation Assembly" the disclosure of which is hereby incorporated by reference. No heavy copper traces are needed on the printed circuit board due to the present invention's high current busing capability, and thus the high expense and weight of such boards is eliminated.

The present invention provides a variety of advantages. The present invention provides a stout and reliable electrical terminal interface to the print circuit board. No extra material is required to provide the stout reliable electrical interfaces in this invention. The body the terminal that makes up the print circuit board connection can be stamped in a variety of male or female style ends. With the throughput style terminals according to the present invention, the need to introduce high current traces is minimized. By using the side tabs 20 to bus through the printed circuit board terminals the need for high-cost having traces on printed circuit boards is eliminated, thus freeing up the board space for other functions or allows the printed circuit board to be smaller in size. The smaller the board the smaller be electrical distribution center which is advantageous in the current automotive setting. Size and weight are essential factors in placing these electronics centers in a vehicle.

What is claimed is:

1. A product comprising:

an electrical distribution center comprising a printed circuit board having a first and second through hole formed therein, a terminal having a main body portion and an upper or an electrical engagement feature extending upwardly from the main body portion and a mounting tail extending downwardly from the main body portion, a solderable spring tab formed out of the main body portion to leave a hole in the main body portion, and wherein the mounting tail is inserted in the first hole formed in the printed circuit board and an end of the solderable spring tab is inserted into the second through hole formed in the printed circuit board and wherein at least one of the mounting tail and solderable spring tab are soldered to the printed circuit board.

2. A product comprising:

an electrical distribution center as set forth in claim 1 wherein the terminal further comprises a pair of side tabs extending outwardly from opposite sides of the main body portion.

3. A product comprising:

an electrical distribution center as set forth in claim 2 wherein the terminal further comprises a solder cladding on a lower end of each of the side tabs.

4. A product comprising:

an electrical distribution center as set forth in claim 2 wherein each side tab has a lower edge that acts as a stop preventing the further insertion of the terminal into the printed circuit board.

5. A product comprising:

an electrical distribution center as set forth in claim 1 wherein at least one of the through holes in the printed circuit board is plated.

6. A product comprising:

an electrical distribution center as set forth in claim 1 further comprising a solderable material surrounding each of the first and second through holes in the printed circuit board.

7. A product comprising:

an electrical distribution center as set forth in claim 1 wherein the mounting tail comprises a second electrical engagement feature.

8. A product comprising:

an electrical distribution center as set forth in claim 7 wherein one of the first and second electrical engagement features comprises a male blade.

9. An electrical distribution center as set forth in claim 7 wherein one of the first and second electrical engagement features comprises a tuning fork.

10. A product comprising:

an electrical distribution center as set forth in claim 7 wherein the first electrical engagement feature comprises a male blade.

11. A product comprising:

an electrical distribution center as set forth in claim 7 wherein the first electrical engagement feature comprises a tuning fork.

12. A product comprising a printed circuit board having a first and second through hole formed therein, a terminal having a main body portion and an upper electrical engagement feature extending upwardly and a mounting tail extending downwardly from the main body portion, a solderable spring tab formed out of the main body portion to leave a hole in the main body portion, and wherein the mounting tail is inserted in the first hole formed in printed circuit board and an end of the solderable spring tab is inserted into the second through hole formed in the printed circuit board and wherein the mounting tail and solderable spring tab are soldered to the printed circuit board.

13. A product as set forth in claim 12 wherein the mounting tail comprises a second electrical engagement feature.

14. A product as set forth in claim 12 wherein the second electrical engagement feature comprises a male blade.

15. A product as set forth in claim 12 wherein the first electrical engagement feature comprises a male blade.

16. A product comprising:

a terminal having a main body portion with a hole formed therethrough and a first electrical engagement feature extending upwardly from the main body portion and a mounting tail extending downwardly from the main body portion, and wherein the main body portion includes two side strips of metal spaced apart by the hole formed in the main body portion, and wherein the terminal is constructed and arranged so that the two side strips deform and move into the area of the hole formed in the main body portion upon pressure exerted in the outer edges of the two side strips, and a solderable spring tab stamped and bent out of the main body portion to leave the hole formed in the main body portion.

17. A produce as set forth in claim 16 wherein the mounting tail comprises a second electrical engagement feature.

* * * * *